US006088991A

United States Patent [19]

Nassef

[11] Patent Number: 6,088,991

[45] Date of Patent: Jul. 18, 2000

[54] METHOD OF FORMING A REINFORCEMENT MAT ASSEMBLY

[76] Inventor: Namon A. Nassef, 11562 Clear Creek Dr., Pensacola, Fla. 32514

[21] Appl. No.: 09/456,119

[22] Filed: Dec. 7, 1999

Related U.S. Application Data

[62] Division of application No. 09/115,174, Jul. 14, 1998.

[51] Int. Cl.[7] ..... E04G 21/12

[52] U.S. Cl. ..... 52/745.1; 52/677; 52/687; 29/897.34; 29/525.05; 29/413; 404/135

[58] Field of Search ..... 52/745.1, 745.2, 52/677, 684, 685, 686, 687, 688, 689; 29/897.15, 897.34, 525.05, 413; 404/134, 135, 136

[56] References Cited

U.S. PATENT DOCUMENTS

| | | | |
|---|---|---|---|
| 1,581,574 | 4/1926 | Heath et al. | 52/100 |
| 1,583,921 | 5/1926 | Garber | 52/100 |
| 1,611,373 | 12/1926 | Reagan | 52/100 |
| 2,036,131 | 3/1936 | Gaeryner et al. | 52/100 |
| 2,086,989 | 7/1937 | Raad | 52/100 |
| 4,932,174 | 6/1990 | Anderson | 52/98 |
| 5,123,221 | 6/1992 | Legault | 52/608 |

FOREIGN PATENT DOCUMENTS

| | | | |
|---|---|---|---|
| 568597 | 6/1958 | Belgium | 52/98 |
| 466266 | 10/1951 | Italy | 52/98 |
| 149743 | 8/1920 | United Kingdom | 52/100 |

*Primary Examiner*—Michael Safavi
*Attorney, Agent, or Firm*—Peter Loffler

[57] ABSTRACT

A method of using a support unit for providing a plurality of sub-units, each of the sub-units adapted to hold construction structures such as reinforcing mats off of the ground or form is comprised of a body member having at least one set of at least one slit along the body for providing a weakened area on the body. An opening is located one either side of each of the at least one slit. Sub-units are broken off from the body member and the sub-unit is used to hold the construction structures. Each sub-unit can be secured to the construction structure via the openings.

10 Claims, 9 Drawing Sheets

METHOD OF FORMING A REINFORCEMENT MAT ASSEMBLY

This application is a divisional of application number Ser. No. 09/115,174 filed on Jul. 14, 1998.

BACKGROUND OF THE INVENTION

1. Field of the Invention

The present invention relates to a method of forming a reinforcement mat assembly using a support unit that is divided into two or more sub-units, each sub-unit being secured to a reinforcement mat assembly to hold the assembly off of the ground or surface.

2. Background of the Prior Art

In performing concrete work, such as laying a building foundation, it is necessary to hold the reinforcing steel, wire, or mat off of the ground or surface during the pour so that the mat is properly positioned within the medial portion of the concrete slab once it is set. The common method currently employed is to position a piece of construction material, such as a broken brick or a wire chair, under normally intersecting members of the reinforcing mat. The mat sits upon these pieces and is maintained thereon by gravity.

The problem with this method is that the pieces become dislodged as workers walk about the mat pour area before the actual pour. This dislodgment causes parts of the mat to sag or outright contact the ground or form resulting in a weakened and possibly improperly constructed structure.

Therefore, there is a need in the art for a device that will assist in holding a reinforcing member off of the ground or form a specified distance prior to the concrete pour. Such a device may be secured to the reinforcing mat once the device is positioned and will not become easily dislodged by passing workers. Such a device will be of relatively simple design and construction and will be easy to use and install.

SUMMARY OF THE INVENTION

The method for forming a reinforcement mat assembly using a support unit of the present invention addresses the aforementioned needs in the art. The support unit provides a device that is secured to a reinforcing mat and holds the mat in proper position off of the ground or form prior to the concrete pour. The device is simple in design and construction utilizing common methods of manufacture. The support unit is easy to use and install. The device, which can have a plurality of available altitudes within which to position the reinforcing mat, can be used in a variety of other applications such as separating forms, in positioning pipe, in shemming equipment for permanent foundations, etc.

The method of the present invention uses a support unit that is comprised of a body member which can have any desired shape such as rectangular, triangular, cylindrical, circular, arbitrary, etc. At least one set of slits is disposed within the body member and openings that each passes through the body member are located on either side of each set of slits although only one opening may be provided between two adjoining slits. Each set of slits may be one continuous slit that encompasses at least a part of the outer periphery of the body member or may be a plurality of slits. Each individual set of slits is generally oriented on the same plane.

Each set of slits provides a weakened area on the body member. A portion of the body member is struck with sufficient force as to break the body member along one of the sets of slits breaking a sub-unit off from the remainder of the body member. This sub-unit has an opening passing through it. This sub-unit is positioned at an appropriate location, such as under two intersecting reinforcing members or along a long stretch of a single reinforcing member, of the reinforcing mat and the sub-unit is secured thereto, with the securing material passing through the opening. The securing material, which may be wire, string, etc., holds the sub-unit in place even if kicked or otherwise disturbed by a worker or other outside forces. Additional sub-units are broken off from the body member until all sub-units are broken off or the amount needed is obtained.

BRIEF DESCRIPTION OF THE DRAWINGS

Similar reference numerals refer to similar parts throughout the several views of the drawings.

DESCRIPTION OF THE PREFERRED EMBODIMENT

Figure 1:
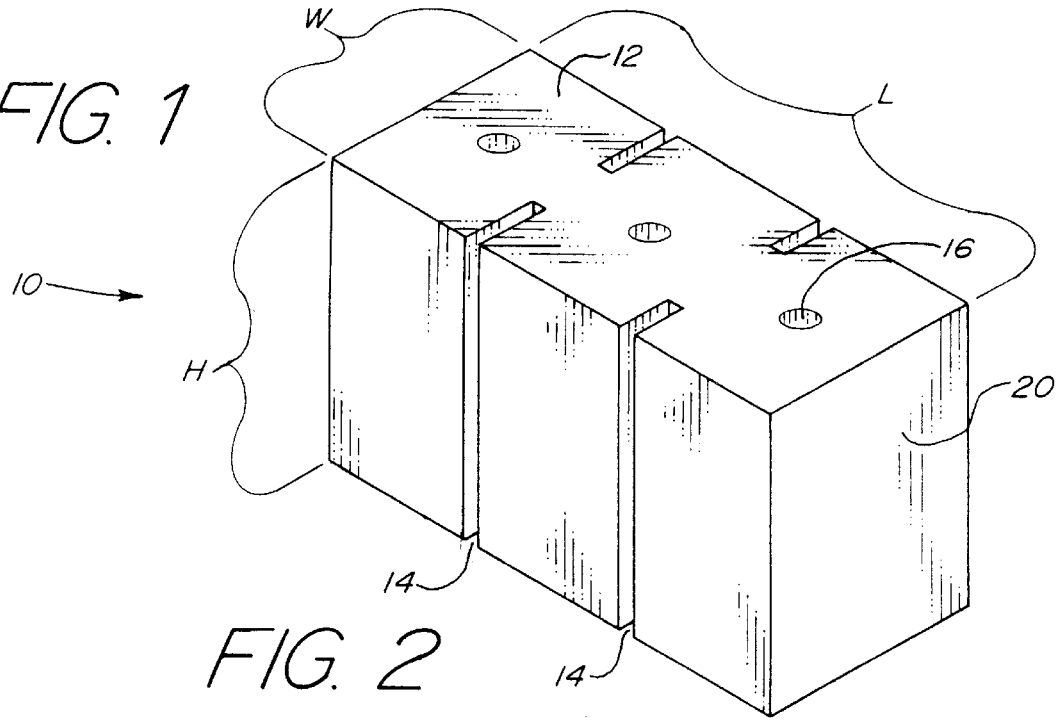
FIG. 1 is a top perspective view of the support unit, having generally parallel sets of slits.
Figure 2:
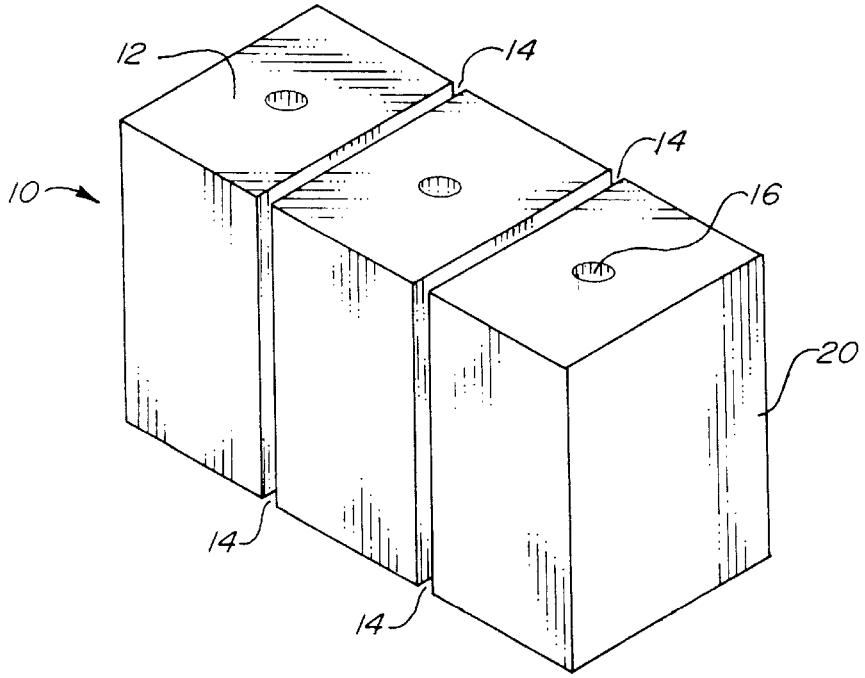
FIG. 2 is a bottom perspective view of the support unit.
Figure 3:
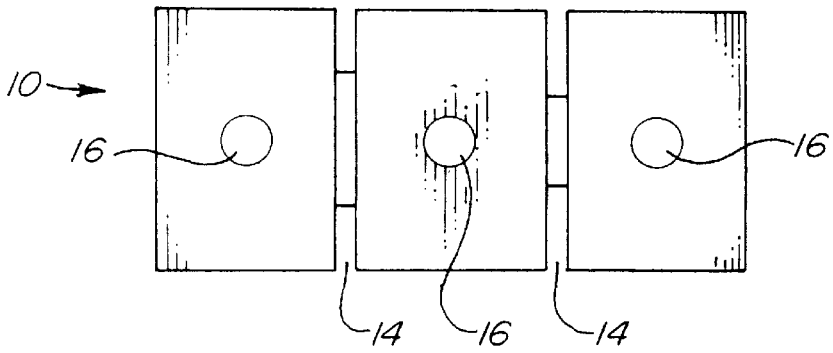
FIG. 3 is a bottom plan view of the support unit.
Figure 4:
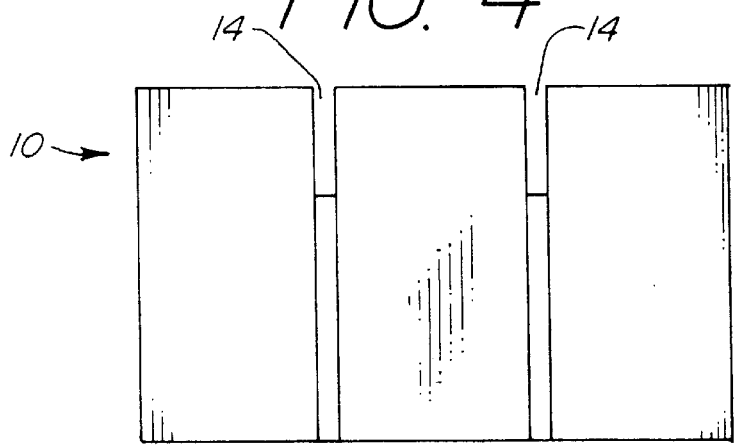
FIG. 4 is a side elevation view of the support unit.
Figure 5:
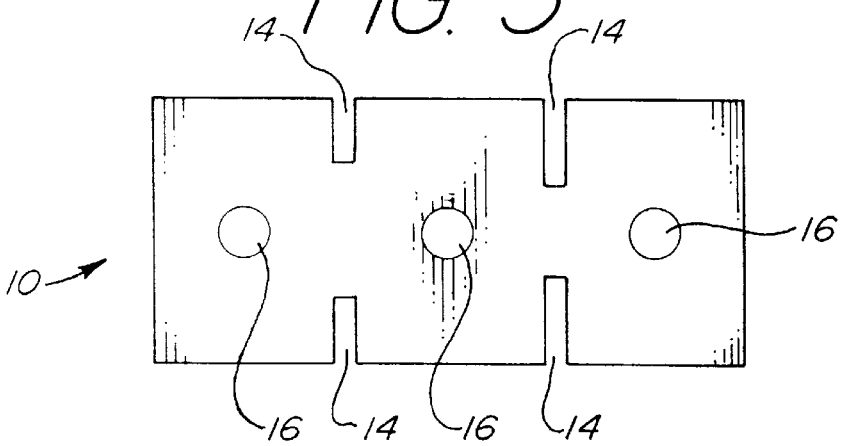
FIG. 5 is a top plan view of the support unit.
Figure 6:
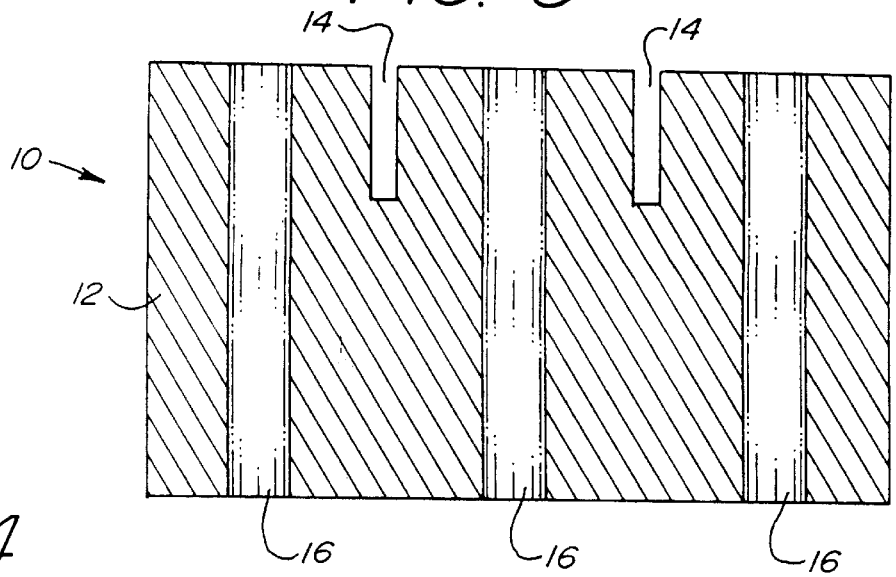
FIG. 6 is a sectioned view of the support unit.
Figure 14:
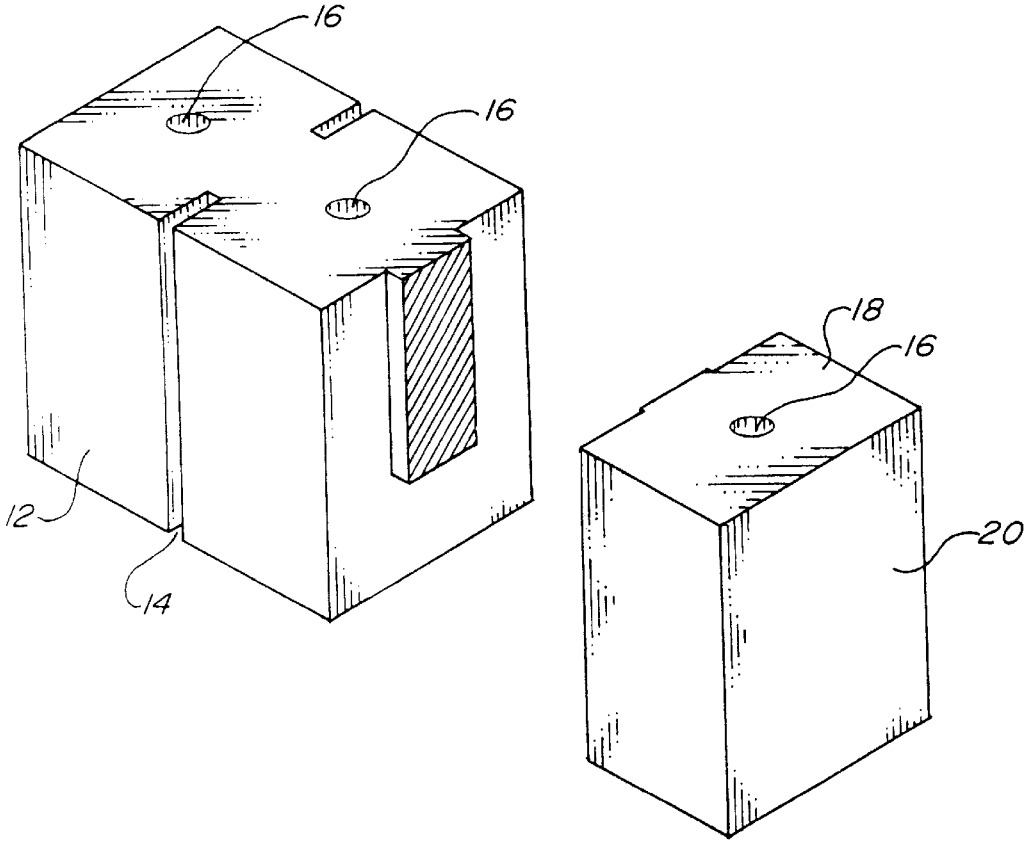
FIG. 14 is a perspective view of a sub-unit broken off from the body member.
Figure 7:
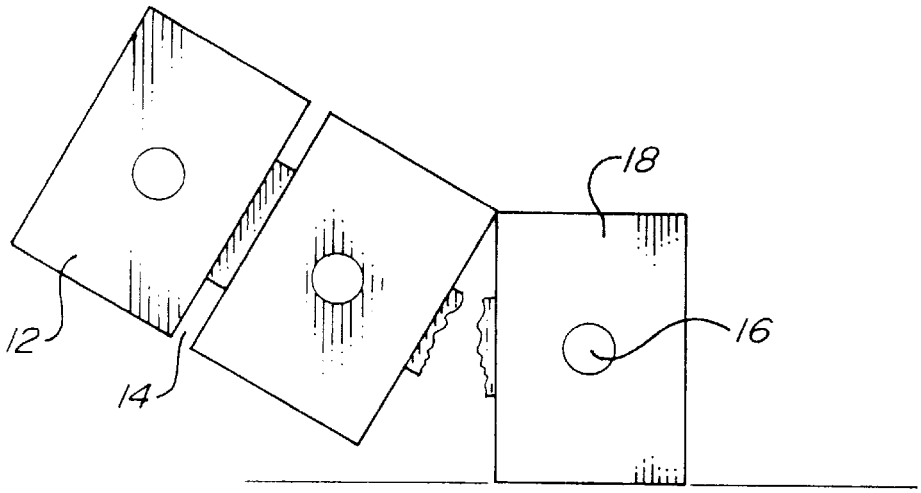
FIG. 7 illustrates one of the sub-units being broken off from the body member.
Figure 8:
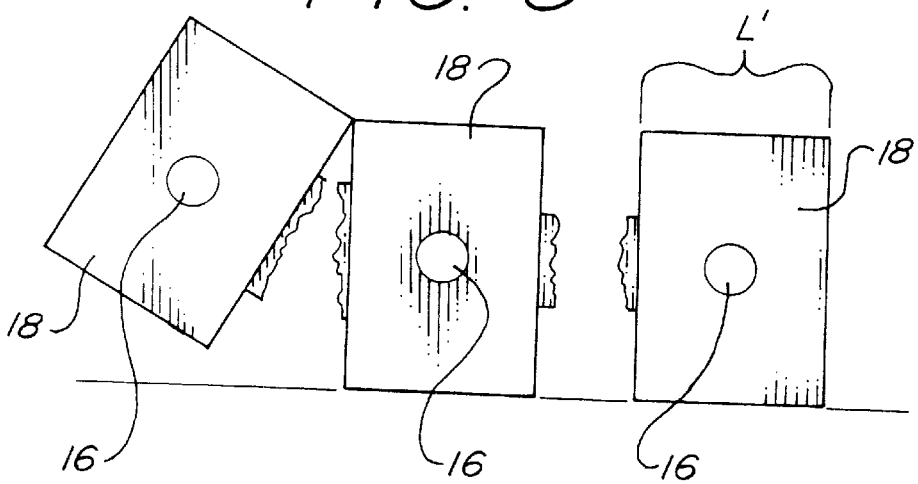
FIG. 8 illustrates the body member being completely broken into individual sub-units.

Referring now to the drawings, it is seen that the method of forming a reinforcement mat assembly of the present invention utilizes a support unit, generally denoted by reference numeral 10, that is comprised of a body member 12. The body member 12, which may be a brick or other appropriate material, may have any shape such as rectangular, triangular, cylindrical, circular, or any other desired shape. At least one set of slits 14 is disposed on the body member 12. Each set of slits 14 may be one continuous slit that encompasses, either partially (illustrated) or completely (not illustrated), the outer periphery of the body member 12, or may be a plurality of slits disposed on the body member 12, with each individual set of slits being generally disposed on the same plane and being disposed in spaced apart relation to any other set of slits 14. Each set of slits 14 provides a weakened area on the body member 12. An opening 16 is located on either side of each set of slits 14 such that only one opening 16 need be located between two sets of adjoining slits 14.

Figure 11A:
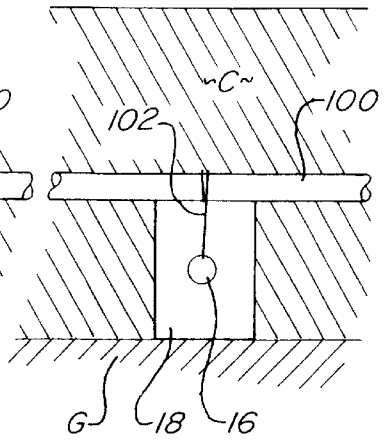
FIG. 11A illustrates, in side elevation view, a single sub-unit being attached to a single section of rebar.
Figure 10A:
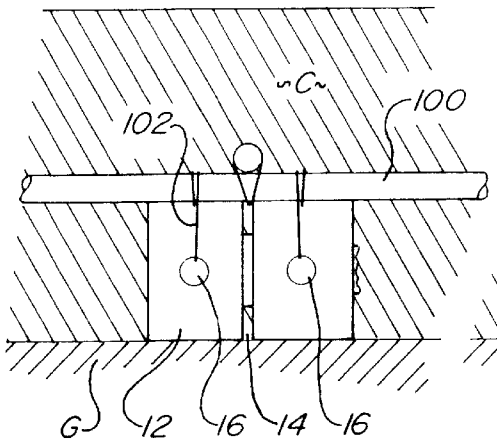
FIG. 10A illustrates, in side elevation view, two sub-units, still attached, being attached to either side of intersecting rebars of a reinforcement mat.
Figure 9A:
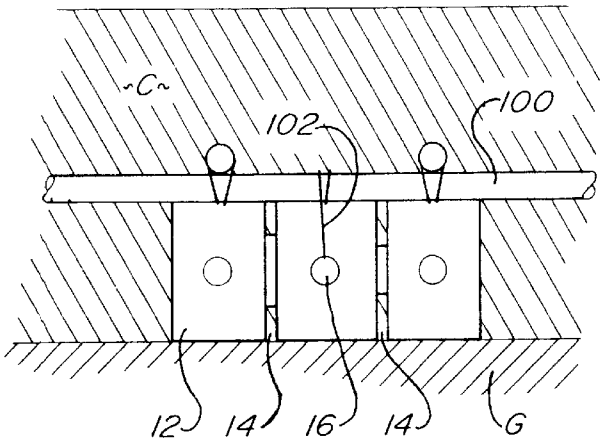
FIG. 9A illustrates, in side elevation view an entire body member being attached to a reinforcing mat.
Figure 11B:
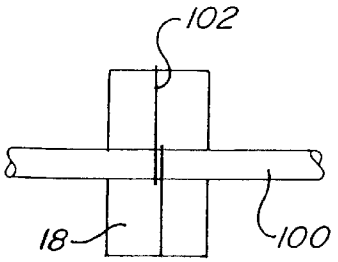
FIG. 11B is a top plan view of figure 11A.
Figure 10B:
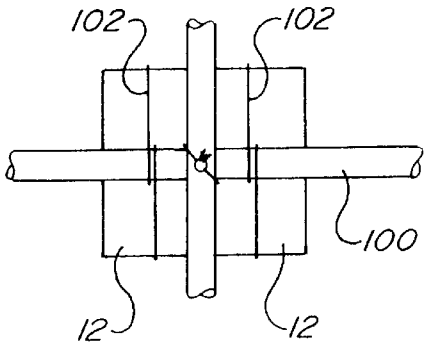
FIG. 10B is a top plan view of FIG. 10A.
Figure 9B:
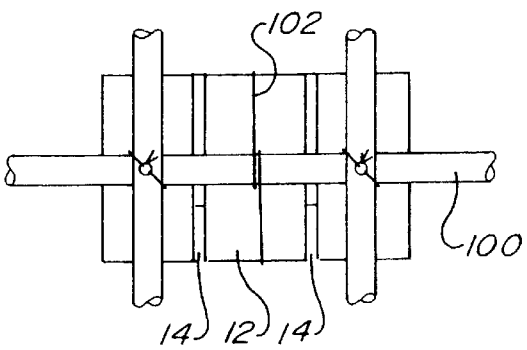
FIG. 9B is a top plan view of FIG. 9A.
Figure 13A:
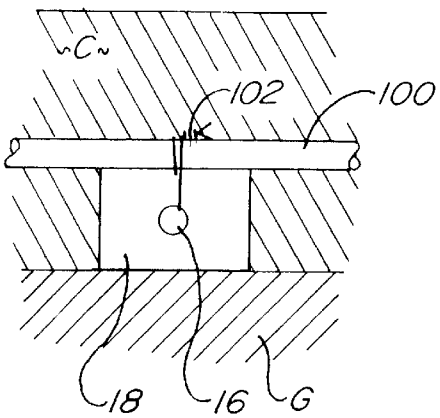
FIG. 13A illustrates, in side elevation view, a single sub-unit attached to a single section of rebar with the sub-unit oriented to provide a different height of separation, relative to the height of FIGS. 9A–11B.
Figure 12A:
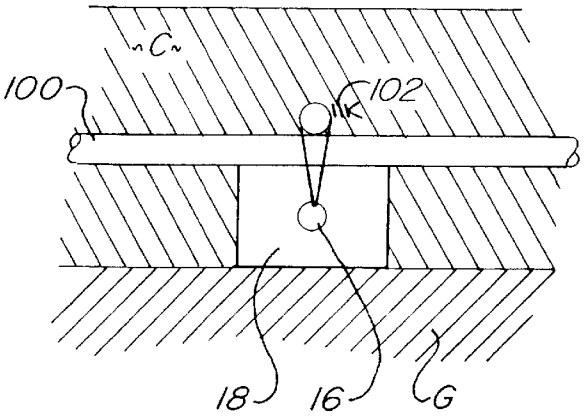
FIG. 12A illustrates, in side elevation view, a single sub-unit attached to the intersection of rebars of a reinforcement mat with the sub-unit oriented to provide a different altitude of separation, relative to the height of FIGS. 9A–11B.
Figure 13B:
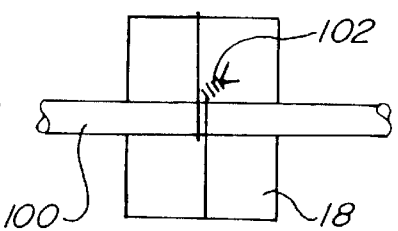
FIG. 13B is a top plan view of FIG. 13A.
Figure 12B:
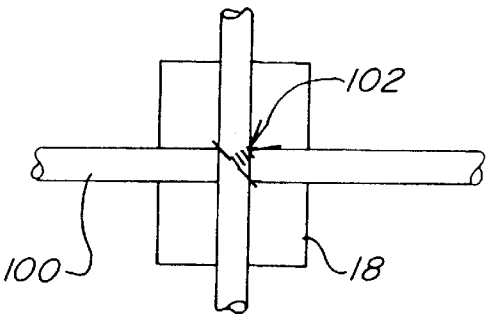
FIG. 12 is a top plan view of FIG. 12A.
Figure 15:
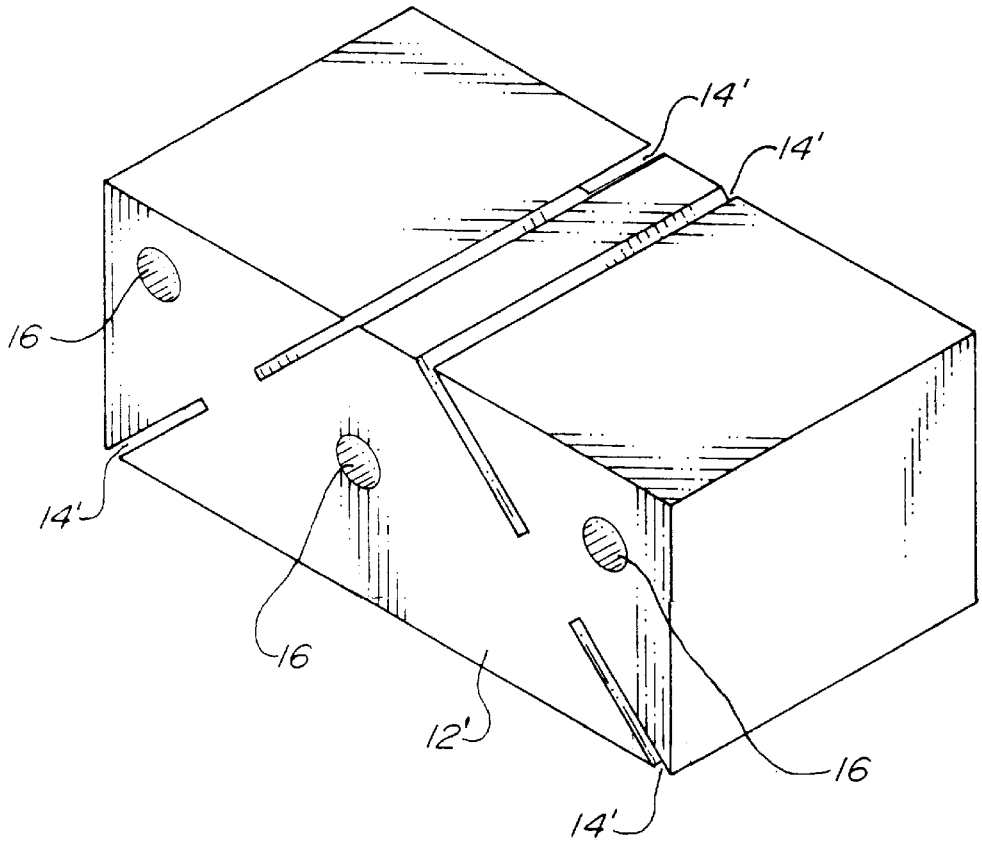
FIG. 15 is a top perspective view of the support unit, having generally diagonally disposed sets of slits, of the present invention.
Figure 20:
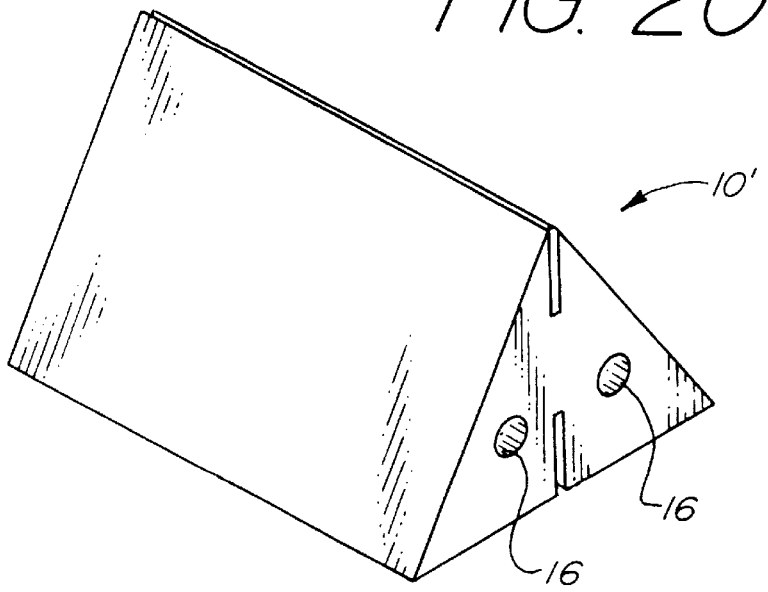
FIG. 20 is a perspective view of a generally triangular body member
Figure 16:
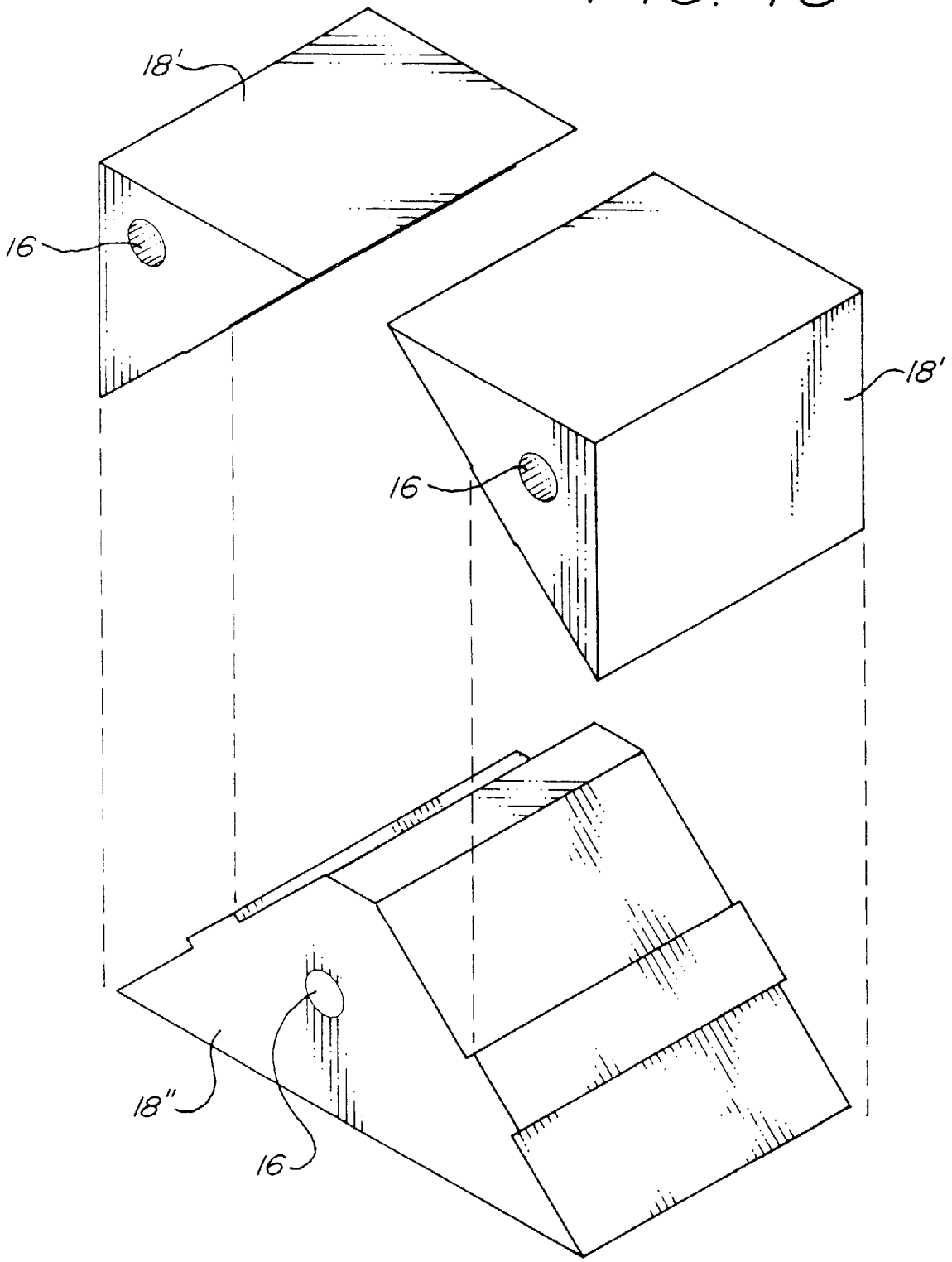
FIG. 16 is a top perspective view of the body member of FIG. 15 with two sub-units exploded from the third sub-unit.
Figure 19:
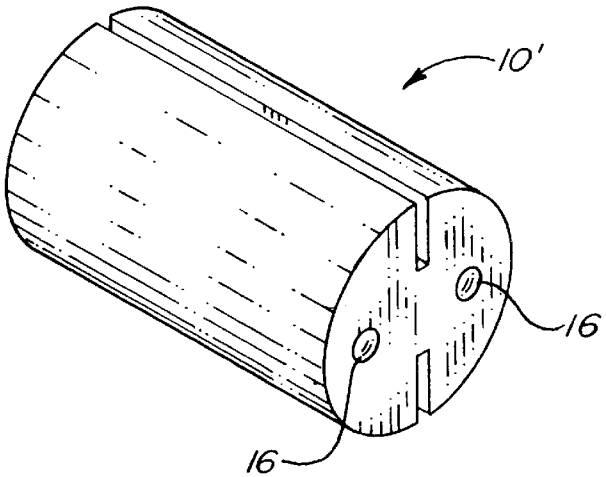
FIG. 19 is a perspective view of a generally cylindrical body member.
Figure 17:
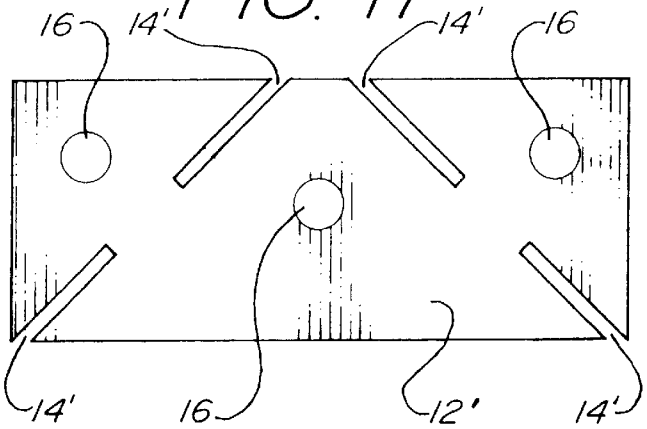
FIG. 17 is a side elevation view of FIG. 15.
Figure 18:
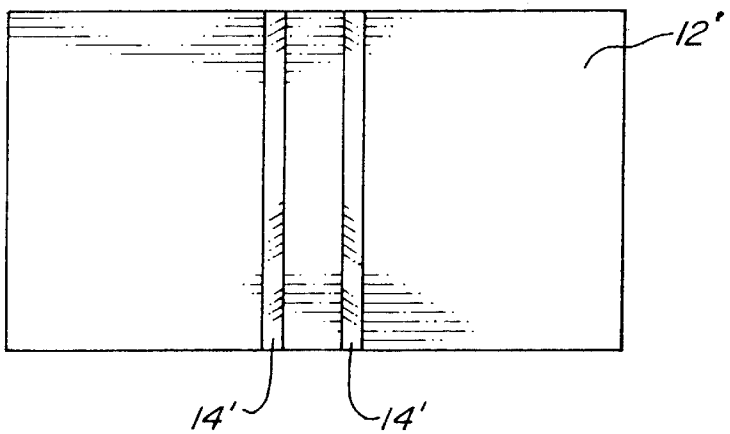
FIG. 18 is a top plan view of FIG. 15.

In order to use the support unit 10 of the present invention, a worker strikes the body member 12 with sufficient force so as to break a sub-unit 18 off from the body member 12, the break occurring generally along one of the sets of slits 14. The sub-unit 18 is positioned along the reinforcement mat 100 (or other structure as desired) at a desired location and secured thereto with the securing material 102 passing through the opening 16. FIGS. 9A–13B illustrate, by way of example, some of the possible placements of the sub-units 18.

The exact geometry of the body member 12 and the frequency and placement of the sets of slits 14 is determined by the specific job requirements. For example, the body member may be rectangular having a length L, a width W, and a height H. The length L, width W, and height H of such a body member may but need not necessarily be all different to one another. Furthermore, each set of slits 14 will be generally parallel to the ends 20 of the body member 12 such that each sub-unit will also be generally rectangular. Advantageously but not necessarily, each sub-unit will have a length L' that is different to the width W and height H. Therefore, each sub-unit 18 will have a length L', a width W and a height H that are all different giving a worker the opportunity to adjust the altitude of the reinforcing mat 100 from the ground or surface. The sub-unit 18 is oriented so as to achieve the desired amount of altitude to the reinforcement mat 100. The length L' of each sub-unit 18 within a given body member 12 may or may not be different from each other sub-unit.

Alternately, each set of slits 14' may be disposed in diagonal orientation to the ends 20 of the body member 12' so as to provide generally triangular sub-units 18' and a quadrilateral sub-unit 18" from the body member 12'. Each individual sub-unit from such a body member 12' can be advantageously applied to the work site as needed based on the particular dimensions of each individual sub-unit.

Other body members 10' may be provided that have other than rectangular shapes that provide sub-units with other than rectangular shapes. For example, a hemispherical body member may provide two semi-hemispherical sub-units. The particular shape of the body member is dependent upon the particular job to be accomplished.

While the invention has been particularly shown and described with reference to an embodiment thereof, it will be appreciated by those skilled in the art that various changes in form and detail may be made without departing from the spirit and scope of the invention.

I claim:

1. A method for forming a reinforcement mat assembly comprising the steps of:

providing a reinforcement mat;

providing a body member that has a slit disposed within the body member and oriented on a first plane, the first plane having a first side and a second side, a first opening passing through the body member in spaced apart relation to the first side, and a second opening passing through the body member in spaced apart relation to the second side;

breaking the body member into two pieces generally along the slit;

providing a first securing member;

passing the first securing member through the first opening and tying the first securing member to the reinforcement mat;

providing a second securing member; and passing the second securing member through the second opening and tying the second securing member to the reinforcement mat.

2. The method as in claim 1 wherein the body member is generally rectangular having a pair of opposing ends, a pair of opposing side faces and a pair of opposing front faces, and having a length, a width and a height.

3. The method as in claim 2 wherein the length is different than the width and the length is different than the height.

4. The method as in claim 3 wherein the width is different than the height.

5. The method as in claim 2 wherein the first plane is located a first distance from one of the pair of ends and a second distance from the other of the pair of ends and where the first distance is different from the width and is different than the height and the second distance is different than the width and is different than the height.

6. The method as in claim 5 wherein the first distance is different than the second distance.

7. The method as in claim 2 wherein the first plane is disposed in generally parallel orientation to the pair of opposing ends.

8. The method as in claim 2 wherein the first plane is disposed in diagonal orientation to the pair of opposing ends.

9. The method as in claim 1 wherein the body member is a generally triangular.

10. The method as in claim 1 wherein the body member is a generally cylindrical.

* * * * *